US006519910B2

(12) United States Patent
Gierss

(10) Patent No.: US 6,519,910 B2
(45) Date of Patent: Feb. 18, 2003

(54) SPOT MAST FOR A CARRYING SYSTEM

(75) Inventor: Karsten Gierss, Fellbach (DE)

(73) Assignee: Karsten Gierss, Waiblingen (DE)

( * ) Notice: Subject to any disclaimer, the term of this patent is extended or adjusted under 35 U.S.C. 154(b) by 0 days.

(21) Appl. No.: 09/870,724

(22) Filed: Jun. 1, 2001

(65) Prior Publication Data

US 2002/0007612 A1 Jan. 24, 2002

(30) Foreign Application Priority Data

Jun. 2, 2000 (DE) ..... 200 09 896 U

(51) Int. Cl.[7] ..... F16B 7/00

(52) U.S. Cl. ..... 52/726.3; 52/736.1; 52/726.4; 52/98; 52/732.2; 403/297; 403/362

(58) Field of Search ..... 52/726.3, 726.4, 52/736.1, 736.4, 737.5, 98

(56) References Cited

U.S. PATENT DOCUMENTS 2,169,102 A * 8/1939 Lemont ..... 403/389
2,192,048 A * 2/1940 Mueller ..... 403/297
2,846,221 A 8/1958 Skinner
4,344,719 A * 8/1982 Thom ..... 403/297
4,859,109 A * 8/1989 Targetti ..... 403/297
5,860,253 A * 1/1999 Lapointe ..... 52/98

FOREIGN PATENT DOCUMENTS

DE 92 17 865 U1 5/1993

* cited by examiner

*Primary Examiner*—Carl D. Friedman
*Assistant Examiner*—Basil Katcheves
(74) *Attorney, Agent, or Firm*—Crowell & Moring LLP

(57) ABSTRACT

A mast for a carrying system has carriers which can be vertically moved by way of a runner guided on the mast and which are used for holding stage-related implements. The mast includes several tube sections of the same diameter which are aligned with respect to one another, and an interior tube piece by which the tube sections are connected with one another at a boundary. The interior tube piece is a sleeve which is slotted along a surface line, thereby defining a slot, and is penetrated by at least one pressure screw which acts by way of a pressure piece with a convex outer contour upon counterpressure pieces. The counterpressure pieces also have convex outer contours and are provided at edges of the slot.

31 Claims, 3 Drawing Sheets

SPOT MAST FOR A CARRYING SYSTEM

This application claims the priority of German application 200 09 896.9, filed Jun. 2, 2000, the disclosure of which is expressly incorporated by reference herein.

BACKGROUND AND SUMMARY OF THE INVENTION

The present invention relates to a mast for a carrying system having carriers which can be vertically moved by way of a runner guided on the mast and used for holding stage-related implements. The mast is constructed of several tube sections of the same diameter which are aligned with respect to one another and connected with one another at boundaries by an interior tube piece.

A carrying system of this type is known from German Patent Document DE 9217865 U1. In this system, masts which are erected in floor parts are provided. An erection hinge is provided between the floor part and each mast. For easier erection, this erection hinge connects the mast in a tiltable manner with a tube piece of the floor part.

Since such carrying systems have to be moved to just below the ceilings of rooms, for example, for television or film shots, the masts are, as a rule, constructed of several sections in order to simplify transport of the carrying system to and from the erection site.

In carrying systems intended for large loads such as, for example, a number of flood lights or the like, correspondingly stable mast sections which are to be held on one another without play have to be used in order to ensure stability. So far, this has not been achieved in a sufficiently secure manner.

It is therefore an object of the present invention to construct a carrying system of the initially mentioned type such that the masts, which are constructed of sections, can be assembled in an extremely stable manner.

For achieving this object, in a mast for a carrying system of the initially mentioned type, the interior tube piece consists of a sleeve which is slotted along a surface line and penetrated by a pressure screw, which acts by way of a pressure piece with a convex outer contour, onto counterpressure pieces which are provided on the edge of the slot and also have convex outer contours.

In an extremely simple manner, this permits the successive conversion of the pressure forces introduced along a radial plane through the center of the interior tube piece to forces which lead to a spreading-open of the sleeve along its entire diameter and which do not only cause locking in the area of the slot. This invention, therefore, causes a close, tight and play-free fit of the interior tube piece on the mast sections in the area of their boundaries. As a result, a mast constructed in this manner can be made as stable as a continuous one-piece mast.

As a further development of the invention, the pressure screw can be situated in a radial plane extending through the slot and, in this manner, can cause the desired distribution of the spreading forces. Naturally, several pressure screws, and preferably two, can be provided along the length of the interior tube piece, with each of these screws extending at the same axial distance from the boundary of the mutually joined mast sections.

As a further development of the invention, each of the outer contours of pressure pieces and counterpressure pieces can be a circular-cylindrical surface. This permits the use of prefabricated profile parts. In this case, a pressure piece can be applied to a pressure screw which is provided with a nut resting against a guide piece, with the pressure piece being provided on the guide piece.

As still a further development of the invention, an axial stop can be provided on the side situated opposite the pressure piece. This axial stop, in turn, rests on a rectangular profile resting against the tube wall. This further development prevents a co-rotation of the thread guide when the pressure screw is adjusted.

As yet a further development of the invention, the interior tube piece can be provided with openings for guiding a turning tool for the pressure screw through. The interior tube can also be provided with at least one radial pin which, in particular, projects from the transverse center plane and, as an axial stop, engages in a recess at the boundary between the adjacent mast sections when the mast sections are assembled. This further development ensures correct arrangement of the interior tube piece in the longitudinal direction of the mast sections and simultaneously ensures that the openings for guiding through a turning tool arrive in a position in which they are aligned with corresponding openings in the mast sections.

Finally, it is also possible to provide an extension sleeve at the application head for operating the pressure screw. The extension sleeve reaches through the openings provided in the mast sections and therefore contributes to axially securing the mast sections with respect to one another. This may be particularly necessary when, in addition to the pressure forces upon the mast sections which are normally expected, tension forces may also occur. This can happen, for example, when the masts are not only used for guiding carriers in interior spaces but for the arrangement of a roof in the open air. Wind forces, which act upon the roof, can result in tension forces in the masts. However, if such a carrying frame is provided, then the extension sleeve should not extend to the outside beyond the outer contour of the mast sections in order to ensure perfect free guiding of the runner for the carrying frame.

An embodiment of the invention is illustrated in the drawing figures and is explained in the following description.

DETAILED DESCRIPTION OF THE DRAWINGS

Figure 1:
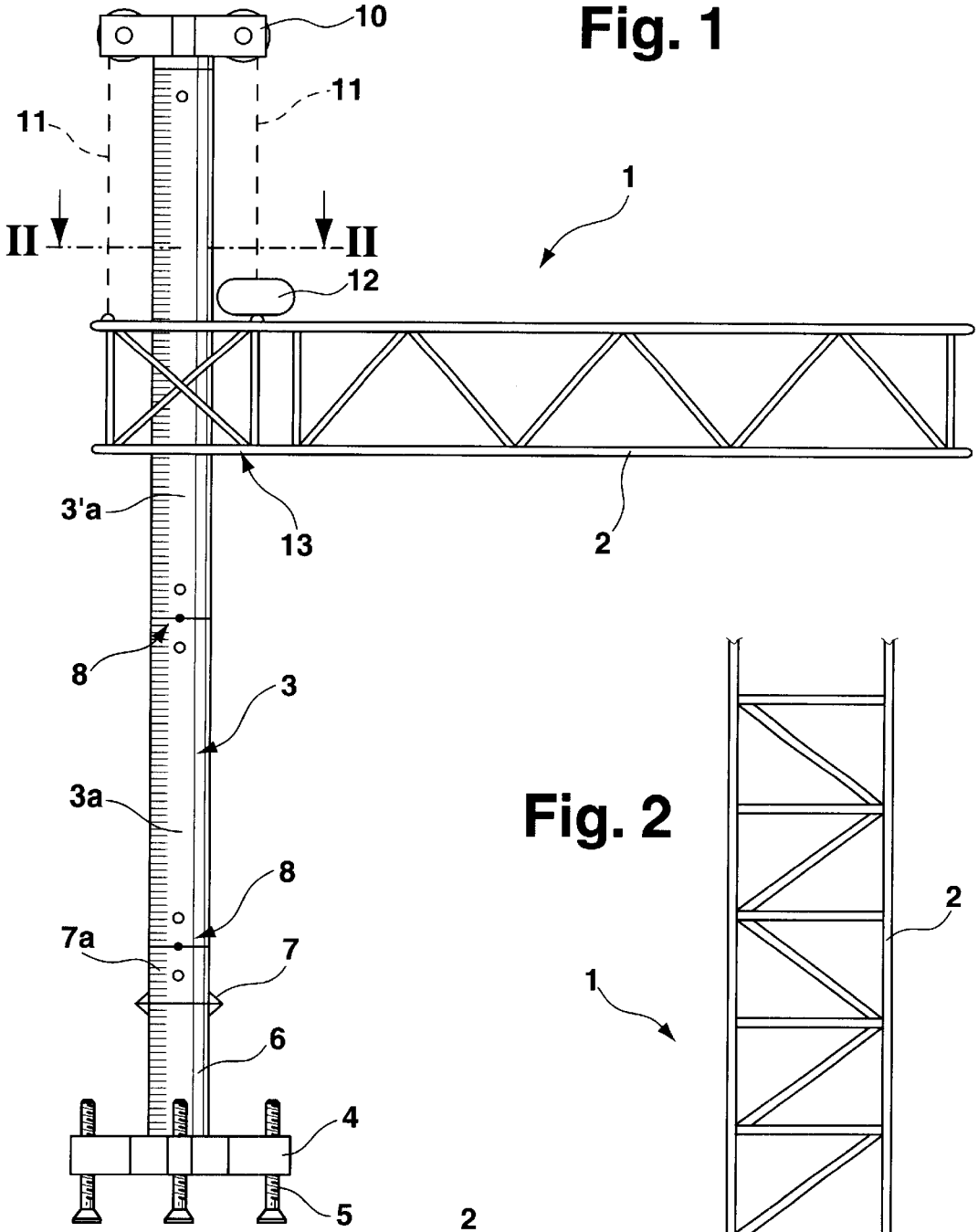
FIG. 1 is a lateral view of a portion of a carrying system for stage-related implements having a mast according to the invention.
Figure 2:
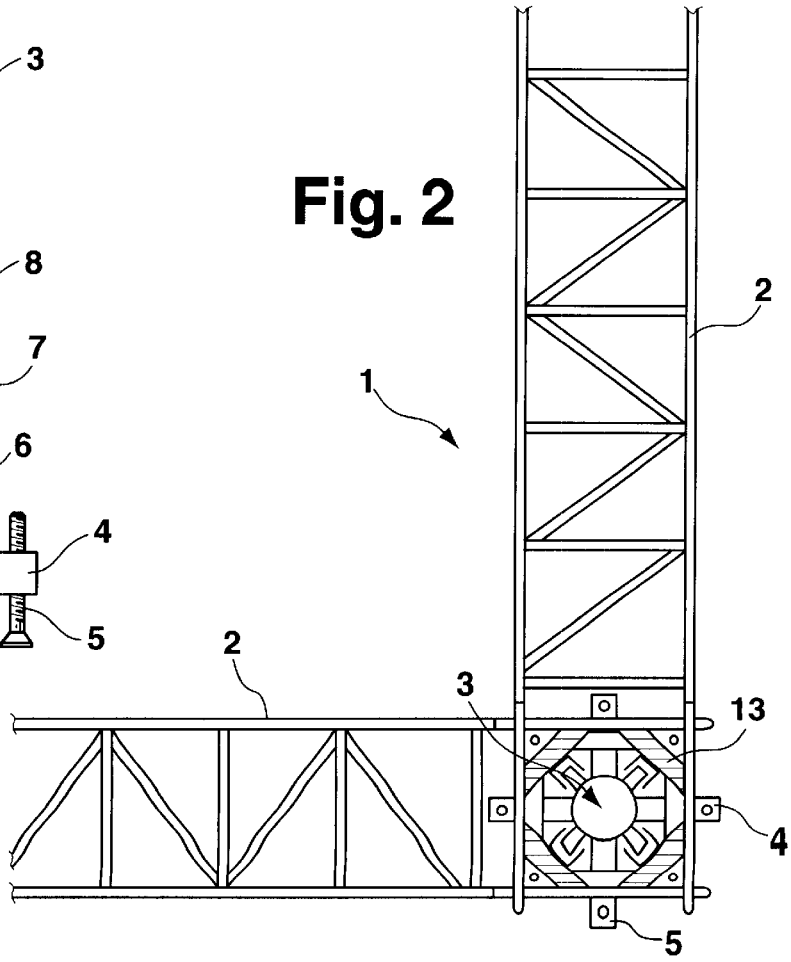
FIG. 2 is a top view of the carrying system according to FIG. 1 along section II—II of FIG. 1.

FIG. 1 illustrates a carrying system 1 for stage-related implements which is constructed of vertically movable carriers 2 and of masts 3 holding these carriers 2 in their vertical position. The masts 3, of which only one respectively is shown in FIGS. 1 and 2, have several sections 3*a* of the same diameter and bases 4 with adjustable supporting spindles 5, which can compensate for unevenness of the floor. A connection tube piece 6 is fastened on each base 4. The connection tube piece is equipped with an erection hinge 7 of the type known from German Registered Utility Patent 92 178 65. Between the connection piece 7*a* of the hinge part 7 and the first section 3*a* of the mast, an interior tube piece in the form of a sleeve 9 is slid in each case into sections 3*a*, 3*a*' and 7*a* in the area of the boundary 8 as well as at the boundary 8 between the first section 3*a* and the second section 3*a*', as illustrated in FIGS. 4 and 5 and shown in FIG. 3 by broken lines. At its upper end, the mast 3 is equipped with a head piece 10 by way of which a cable or a chain 11 is guided. On one side, the cable or chain is fixedly held on the carrier 2 and, on the other side, the cable or chain is held on a hoist 12. The hoist may, for example, be a cable winch or a chain hoist and can change the length of the cable or of the chain 11 which is guided by way of the head piece 10 so that, as a result, the vertical position of the carrier 2 can be adjusted at the mast 3. Each carrier 2 is fastened on a runner part which is guided in a manner known from Registered Utility Patent 92 17 865 on the mast 3.

Figure 3:
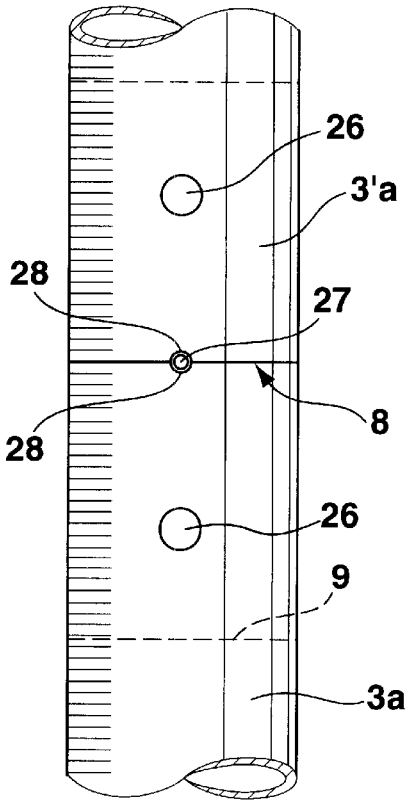
FIG. 3 is an enlarged view of the boundary between two mast sections of the mast according to FIG. 1.
Figure 4:
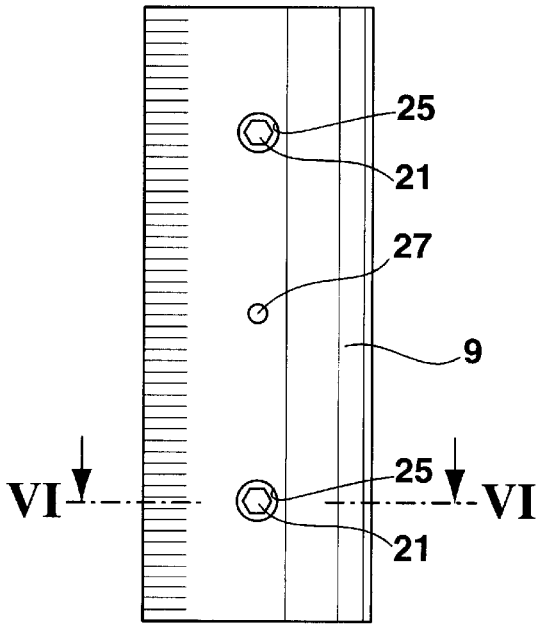
FIG. 4 is a lateral view of an interior sleeve pushed at a boundary into the sections of the mast.
Figure 5:
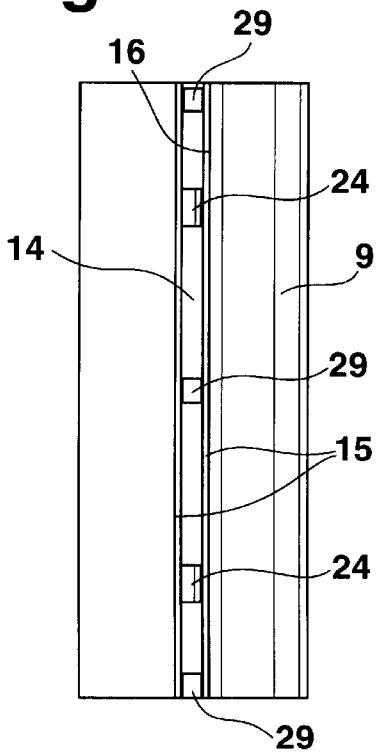
FIG. 5 is a lateral view., which is offset by 180°, of the interior sleeve of FIG. 4.
Figure 6:
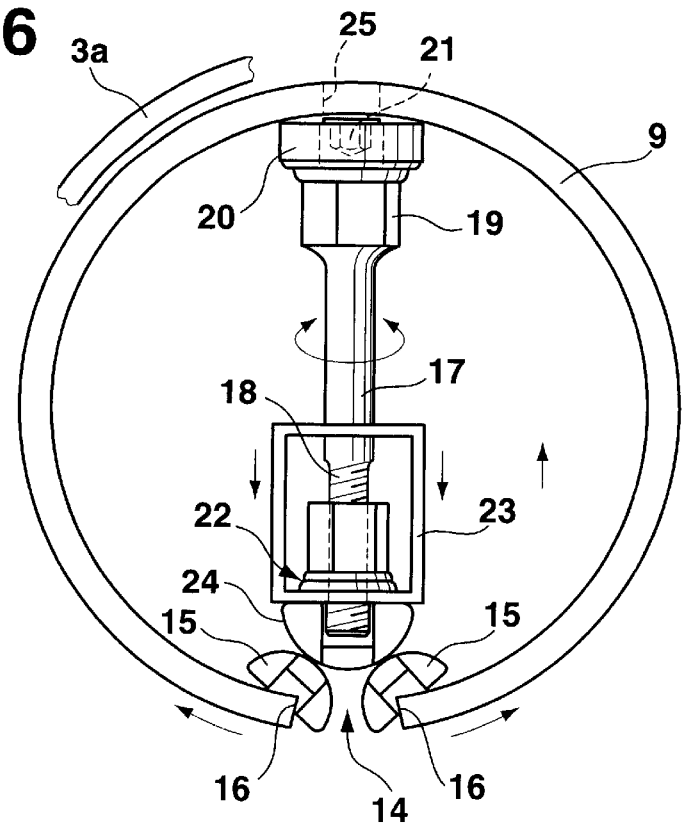
FIG. 6 is an enlarged representation of the sleeve of FIG. 4 along line VI—VI.

FIGS. 3 to 5 demonstrate that the mutually abutting mast sections 3*a* and 3*a*'—analogously, also the mutually abutting sections 3*a* and 7*a* or additional sections—are aligned with one another by an interior tube piece in the form of a sleeve 9. The outside diameter of this sleeve, in the starting condition, is slightly smaller than the inside diameter of sections 3*a* and 3*a*'. As illustrated in FIG. 5, the sleeve 9 is provided with a slot 14 extending along a surface line and, as illustrated particularly in FIG. 6, represents a spreading part whose diameter can be enlarged. Both edges of the slot 14 are provided with profiles 15 which, as illustrated in FIG. 6, are constructed as semicircular profiles with convex outer contours which project into the interior of the sleeve 9. The profiles 15 are firmly attached, for example by welding, to the edges 16 of the slot 14.

In a radial plane extending through the center of the slot 14, as illustrated in FIG. 6 or 4, two pressure screws 17 are arranged at the same distance from the boundary 8. FIG. 6 shows only the lower pressure screw 17 of FIG. 4. However, the upper pressure screw also corresponds to that illustrated in FIG. 6. At one of its ends, the pressure screw 17 is equipped with a thread 18. At its end situated opposite the thread 18, the pressure screw has stop head 19, which is fixedly connected with it, in the form of a welded-on collar nut which presses against a flat profile 20. The flat profile is provided with a passage opening for the end of the pressure screw 17, this end being provided with a hexagon socket 21 for turning the pressure screw 17. At the end of the pressure screw 17 opposite the stop head 19, a collar nut 22 is screwed onto the thread 18 and presses on the inside against a guide piece 23. The guide piece is non-rotatably held in the sleeve 9 and is provided with a pressure piece 24 having a concave outer contour which is pressed against the concave exterior sides of the profiles 15.

In the embodiment shown, the pressure piece 24 is part of a semicircular profile. The pressure strips 15 are also formed by such semicircular profiles with circular cross-sections.

In order to make the hexagon socket 21 accessible for operating the pressure screw 17, the sleeve 9 is provided with a bore 25. After the installation of the sleeve 9 into the mast sections 3*a*, 3*a*', the bore 25 is aligned with openings 26 in the mast sections, so that the pressure screw 17 can be turned from the outside by means of a tool.

In order to ensure that, after installation of the sleeve 9, the openings 25 in the sleeve are aligned with the openings 26 in the mast sections, the sleeve 9 is provided with an axially projecting pin projection 27. After installation, the axially projecting pin projection engages in semicircular recesses 28 at the ends of the mast sections 3*a* and 3*a*' and thus ensures that the operating openings 25 for the pressure screws are also aligned with the assigned openings 26 in the mast sections.

FIG. 5 shows that spacing blocks 29 are fastened to one edge 16 of the slot 14. The spacing blocks have the purpose of holding the spread-open sleeve 9 under a certain prestress which is utilized for ensuring the reduction of the diameter of the sleeve 9 before assembly or during disassembly. As a result, the sleeve 9 is also constructed as a type of spreading spring which can be spread apart by the effect of the pressure screw 17 and can therefore be enlarged in diameter. However, as a result of its inherent elasticity, the sleeve also decreases its diameter again when the pressure screw 17 is unscrewed.

FIG. 6 illustrates that, as a result of a rotation of the pressure screw 17 in one direction, the collar nut 22 is guided to a larger spacing of the collar nut 19. As a result, the pressure piece 24 is pressed with its convex outer contour against the outer contour of the pressure strips 15 so that, as illustrated in FIG. 7, forces are therefore exercised in the direction of the arrows 30 onto the pressure pieces 15 and thus onto the exterior wall 9*a*.

Figure 7:
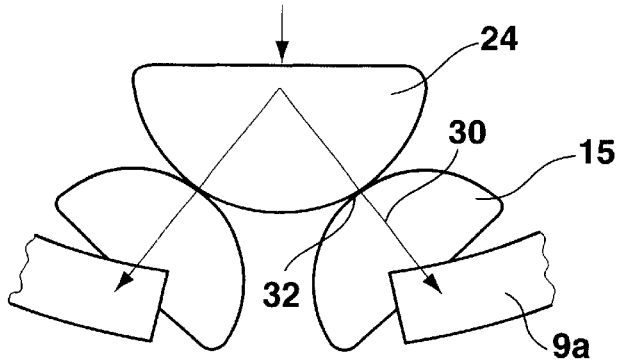
FIG. 7 is an enlarged representation of the pressure piece arrangement according to FIG. 6.

The forces in the direction of the arrows 30 indicated in FIG. 7 can be resolved in a known manner into forces perpendicular to the exterior wall, which is not shown, for example, of section 3*a*, and into a force in the direction of this exterior wall 9*a*.

Figure 8:
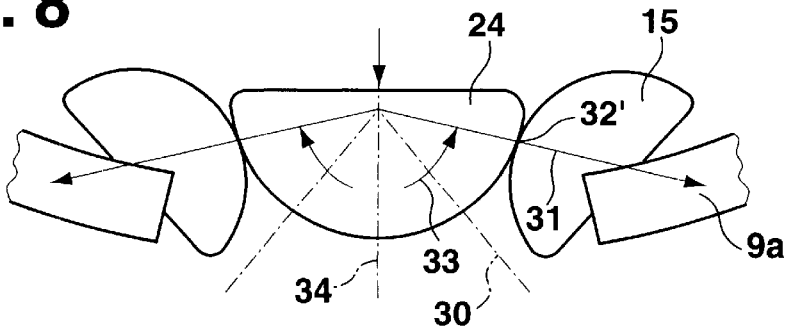
FIG. 8 is a representation of the pressure piece arrangement according to FIG. 7 but in the position during a process of spreading open the sleeve according to FIG. 6.

FIG. 8 shows the situation in which the pressure piece 24 is pressed still farther between the two pressure strips 15. In this case, the contact point 32' between the pressure piece 24 and the strips 15 is displaced on the surface lines of the mutually engaging pressure pieces in the direction of the arrow 33 in comparison to its position 32 in FIG. 7. Measured from the direction 34 of the force exercised by the pressure screw 17, the introduction of force along the arrow 31 into the exterior wall 9*a* therefore takes place at a larger angle. This has the result that, as compared to the position shown in FIG. 7, when the force introduced in the direction of the arrow 31 is resolved, the force component exercised in the direction of the exterior wall of section 3*a* becomes smaller, but the force exercised in the direction of the circumference of the wall 9*a* becomes larger. This in turn results in a spreading-open of the sleeve along the entire circumference. In the tensioned condition, the sleeve 9 is therefore placed snugly against the interior walls of the mutually adjoining sections 3*a*, 3*a*' and 3*a*, 7*a*. This ensures a stable connection of the mast sections which is free of play.

The mast sections 3*a*, 3*a*' illustrated in FIG. 1 are, as a rule, stressed by pressure by the loads, such as flood lights or the like, which are disposed on the carriers 2. The frictional forces exercised by the sleeve 9 are therefore used for play-free assembly. The frictional engagement can undoubtedly also absorb certain forces when tension is exercised on the mast 3. This may specifically occur, for example, when, in the fully upward-moved position, a roof is arranged on the carriers 2 and the entire carrying system is erected in open air rather than in interior spaces. In this case, wind forces may affect the roof, which could result in a tensile loading of the masts 3. In order to achieve a form closure, here, in addition to the frictional engagement, it is possible to extend the operating projections of the pressure screws 17 provided with the hexagon sockets 21 outside to such an extent that engagement takes place into the openings 26 of the mast sections 3*a* and 3*a'*.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A mast for a carrying system having carriers which can be vertically moved by way of a runner guided on the mast and which are used for holding stage-related implements comprising:

several tube sections of the same diameter which are aligned with respect to one another and are held on one another without play between the tube sections, and an interior tube piece by which the tube sections are connected with one another at a boundary, wherein the interior tube piece is a sleeve which is slotted along a surface line thereby defining a slot and is penetrated by at least one pressure screw having a pressure piece with a convex outer contour mounted thereon and engaging counterpressure pieces also having convex outer contours provides at the edges of the slot to change a diameter of the sleeve.

2. The mast according to claim 1, wherein the pressure screw is situated in a radial plane extending through the slot.

3. The mast according to claim 1, wherein the outer contours of the pressure piece and the counterpressure pieces are formed by circular-cylindrical surfaces.

4. The mast according to claim 1, wherein the sleeve is provided with at least one stop pin which projects from the transverse center plane of the sleeve and engages as an axial stop in a respective semicircular recess at the boundary between adjacent tube sections.

5. The mast according to claim 2, wherein the sleeve is provided with openings through which a turning tool for the pressure screw can be guided.

6. The mast according to claim 3, wherein the sleeve is provided with openings through which a turning tool for the pressure screw can be guided.

7. The mast according to claim 5, wherein openings are provided in the tube sections in alignment with the openings of the sleeve.

8. The mast according to claim 6, wherein openings are provided in the tube sections in alignment with the openings of the sleeve.

9. The mast according to claim 2, wherein the sleeve is provided with at least one stop pin which projects from the transverse center plane of the sleeve and engages as an axial stop in a respective semicircular recess at the boundary between adjacent tube sections.

10. The mast according to claim 3, wherein the sleeve is provided with at least one stop pin which projects from the transverse center plane of the sleeve and engages as an axial stop in a respective semicircular recess at the boundary between adjacent tube sections.

11. The mast according to claim 7, wherein the pressure screw is provided with a hexagon socket, for operation, which is mounted on a face-side projection, and wherein said projection reaches into the openings of the tube sections for form-locking axial securing of the tube sections with respect to one another.

12. The mast according to claim 8, wherein the pressure screw is provided with a hexagon socket, for operation, which is mounted on a face-side projection, and wherein said projection reaches into the openings of the tube sections for form-locking axial securing of the tube sections with respect to one another.

13. The mast according to claim 1, wherein the sleeve is provided with openings through which a turning tool for the pressure screw can be guided.

14. The mast according to claim 13, wherein openings are provided in the tube sections in alignment with the openings of the sleeve.

15. The mast according to claim 14, wherein the pressure screw is provided with a hexagon socket, for operation, which is mounted on a face-side projection, and wherein said projection reaches into the openings of the tube sections for form-locking axial securing of the tube sections with respect to one another.

16. The mast according to claim 13, wherein the sleeve is provided with at least one stop pin which projects from the transverse center plane of the sleeve and engages as an axial stop in a respective semicircular recess at the boundary between adjacent tube sections.

17. A mast for a carrying system having carriers which can be vertically moved by way of a runner guided on the mast and which are used for holding stage-related implements comprising:

several tube sections of the same diameter which are aligned with respect to one another, and an interior tube piece by which the tube sections are connected with one another at a boundary, wherein the interior tube piece is a sleeve which is slotted along a surface line thereby defining a slot and is penetrated by at least one pressure screw which acts by way of a pressure piece with a convex outer contour upon counterpressure pieces also having convex outer contours provided at the edge of the slot, and wherein the pressure screw is provided with an adjustable nut which rests against a non-rotatably guided guide piece which has the pressure piece.

18. The mast according to claim 17, and further comprising a stop head provided on a side of the pressure screw situated opposite the pressure piece, wherein the stop head rests against a rectangular profile resting on an interior tube wall.

19. The mast according to claim 17, wherein the sleeve is provided with openings through which a turning tool for the pressure screw can be guided.

20. The mast according to claim 19, wherein openings are provided in the tube sections in alignment with the openings of the sleeve.

21. The mast according to claim 17, wherein the sleeve is provided with at least one stop pin which projects from the transverse center plane of the sleeve and engages as an axial stop in a respective semicircular recess at the boundary between adjacent tube sections.

22. The mast according to claim 20, wherein the pressure screw is provided with a hexagon socket, for operation, which is mounted on a face-side projection, and wherein said projection reaches into the openings of the tube sections for form-locking axial securing of the tube sections with respect to one another.

23. A mast for a carrying system having carriers which can be vertically moved by way of a runner guided on the mast and which are used for holding stage-related implements comprising:

several tube sections of the same diameter which are aligned with respect to one another, an interior tube piece by which the tube sections are connected with one another at a boundary, and a stop head provided on a side of the pressure screw situated opposite the pressure piece, wherein the stop head rests against a rectangular profile resting on an interior tube wall, and wherein the interior tube piece is a sleeve which is slotted along a surface line thereby defining a slot and is penetrated by at least one pressure screw which acts by way of a pressure piece with a convex outer contour upon counterpressure pieces also having convex outer contours provided at the edge of the slot.

24. The mast according to claim 23, wherein the sleeve is provided with openings through which a turning tool for the pressure screw can be guided.

25. The mast according to claim 24, wherein openings are provided in the tube sections in alignment with the openings of the sleeve.

26. The mast according to claim 23, wherein the sleeve is provided with at least one stop pin which projects from the transverse center plane of the sleeve and engages as an axial stop in a respective semicircular recess at the boundary between adjacent tube sections.

27. The mast according to claim 25, wherein the pressure screw is provided with a hexagon socket, for operation, which is mounted on a face-side projection, and wherein said projection reaches into the openings of the tube sections for form-locking axial securing of the tube sections with respect to one another.

28. A mast for a carrying system having carriers which can be vertically moved by way of a runner guided on the mast and which are used for holding stage-related implements comprising:

several tube sections of the same diameter which are aligned with respect to one another, and an interior tube piece by which the tube sections are connected with one another at a boundary, wherein the interior tube piece is a sleeve which is slotted along a surface line thereby defining a slot and is penetrated by at least one pressure screw which acts by way of a pressure piece with a convex outer contour upon counterpressure pieces also having convex outer contours provided at the edge of the slot, wherein the pressure screw is situated in a radial plane extending through the slot, and wherein the pressure screw is provided with an adjustable nut which rests against a non-rotatably guided guide piece which has the pressure piece.

29. A mast for a carrying system having carriers which can be vertically moved by way of a runner guided on the mast and which are used for holding stage-related implements comprising:

several tube sections of the same diameter which are aligned with respect to one another, and an interior tube piece by which the tube sections are connected with one another at a boundary, wherein the interior tube piece is a sleeve which is slotted along a surface line thereby defining a slot and is penetrated by at least one pressure screw which acts by way of a pressure piece with a convex outer contour upon counterpressure pieces also having convex outer contours provided at the edge of the slot, wherein the outer contours of the pressure piece and the counterpressure pieces are formed by circular-cylindrical surfaces, and wherein the pressure screw is provided with an adjustable nut which rests against a non-rotatably guided guide piece which has the pressure piece.

30. A mast for a carrying system having carriers which can be vertically moved by way of a runner guided on the mast and which are used for holding stage-related implements comprising:

several tube sections of the same diameter which are aligned with respect to one another, an interior tube piece by which the tube sections are connected with one another at a boundary, and a stop head provided on a side of the pressure screw situated opposite the pressure piece, wherein the stop head rests against a rectangular profile resting on an interior tube wall, wherein the interior tube piece is a sleeve which is slotted along a surface line thereby defining a slot and is penetrated by at least one pressure screw which acts by way of a pressure piece with a convex outer contour upon counterpressure pieces also having convex outer contours provided at the edge of the slot, and wherein the pressure screw is situated in a radial plane extending through the slot.

31. A mast for a carrying system having carriers which can be vertically moved by way of a runner guided on the mast and which are used for holding stage-related implements comprising:

several tube sections of the same diameter which are aligned with respect to one another, an interior tube piece by which the tube sections are connected with one another at a boundary, and a stop head provided on a side of the pressure screw situated opposite the pressure piece, wherein the stop head rests against a rectangular profile resting on an interior tube wall, wherein the interior tube piece is a sleeve which is slotted along a surface line thereby defining a slot and is penetrated by at least one pressure screw which acts by way of a pressure piece with a convex outer contour upon counterpressure pieces also having convex outer contours provided at the edge of the slot, and wherein the outer contours of the pressure piece and the counterpressure pieces are formed by circular-cylindrical surfaces.

* * * * *